US012780511B2

(12) United States Patent
Kim

(10) Patent No.: US 12,780,511 B2
(45) Date of Patent: Nov. 3, 2026

(54) EASY-TO-OPEN AND CLOSE BEVERAGE CONTAINER CAP AND BEVERAGE APPARATUS EQUIPPED WITH IT

(71) Applicant: SEALVINO, Incheon (KR)

(72) Inventor: Jeong Jun Kim, Gwacheon-si (KR)

(73) Assignee: SEALVINO, Incheon (KR)

( * ) Notice: Subject to any disclaimer, the term of this patent is extended or adjusted under 35 U.S.C. 154(b) by 0 days.

(21) Appl. No.: 19/046,014

(22) Filed: Feb. 5, 2025

(65) Prior Publication Data

US 2026/0131952 A1 May 14, 2026

(30) Foreign Application Priority Data

Nov. 8, 2024 (KR) ..... 10-2024-0157670

(51) Int. Cl.

| | |
|---|---|
| ***B65D 47/20*** | (2006.01) |
| ***A47G 19/22*** | (2006.01) |
| ***B65D 47/06*** | (2006.01) |
| ***B65D 47/26*** | (2006.01) |
| ***B65D 51/18*** | (2006.01) |

(52) U.S. Cl.

CPC ..... *B65D 51/18* (2013.01); *B65D 47/266* (2013.01); *B65D 2251/0025* (2013.01); *B65D 2251/0078* (2013.01)

(58) Field of Classification Search

CPC .. A47G 21/18; B65D 47/266; B65D 47/2031; B65D 47/2043; B65D 51/18; B65D 2251/0025; B65D 2251/0078; B65D 47/2012; B65D 47/2037; B65D 47/066; B65D 47/06; B65D 39/08; B65D 39/0052; F16K 31/521; F16K 7/04; F16K 7/06; F16K 7/08; F16K 7/065; F16K 11/027

USPC ..... 215/322, 229; 220/708, 707; 222/536, 222/530, 528, 527, 529, 547, 286, 73, 74, 222/507, 513, 212, 545, 505, 568, 519, 222/548, 549, 402, 1; 251/4, 7, 8, 9

See application file for complete search history.

(56) References Cited

U.S. PATENT DOCUMENTS 3,261,513 A * 7/1966 Moran ..... B65D 47/242 222/568
3,278,095 A * 10/1966 Johns ..... B65D 47/2043 222/507
3,294,293 A * 12/1966 Johns ..... B65D 47/2043 222/548
3,337,098 A * 8/1967 Johns ..... B65D 47/2043 251/9
3,860,151 A * 1/1975 Moen ..... B65D 47/30 222/513
4,207,996 A * 6/1980 Moen ..... B65D 47/2043 222/513

(Continued)

FOREIGN PATENT DOCUMENTS

KR 102458153 B1 10/2022

*Primary Examiner* — Gideon R Weinerth

(74) *Attorney, Agent, or Firm* — Studebaker Brackett PLLC

(57) ABSTRACT

The present invention relates to a cap equipped on beverage containers. Specifically, the invention pertains to a cap attached to the top of a container storing beverages or food items, including a lower cap, a beverage tube, and an upper cap. The upper cap applies pressure to the beverage tube depending on its degree of rotation, enabling the opening and closing of the container.

7 Claims, 15 Drawing Sheets

(56) References Cited

U.S. PATENT DOCUMENTS

| | | | | | |
|---|---|---|---|---|---|
| 4,998,649 | A * | 3/1991 | Thanisch | B65D 47/2012 | 222/536 |
| 5,339,982 | A * | 8/1994 | Tardie | A47G 19/2266 | 215/229 |
| 6,059,154 | A * | 5/2000 | Bigotte | B65D 47/2043 | 222/530 |
| 7,392,916 | B1 * | 7/2008 | Kuighadush | B65D 77/283 | 220/707 |
| 9,079,205 | B2 * | 7/2015 | Hoskins | A47G 19/2266 | |
| D1,038,671 | S * | 8/2024 | Kim | D9/691 | |
| 2008/0197157 | A1 * | 8/2008 | Troost | B65D 83/303 | 222/402.1 |
| 2017/0101303 | A1 * | 4/2017 | Tomesch | B65D 47/2006 | |
| 2024/0043197 | A1 * | 2/2024 | Kim | B65D 41/02 | |

* cited by examiner

EASY-TO-OPEN AND CLOSE BEVERAGE CONTAINER CAP AND BEVERAGE APPARATUS EQUIPPED WITH IT

CROSS-REFERENCE TO RELATED PATENT APPLICATION

This application claims the benefit of Korean Patent Application No. 10-2024-0157670, filed on Nov. 8, 2024, in the Korean Intellectual Property Office, the disclosure of which is incorporated herein in its entirety by reference.

TECHNICAL FIELD

The present invention relates to caps that can be easily opened and closed, and more specifically to caps applied to containers storing beverages or food items, such as wine, vinegar, or cooking oil, that are prone to changes when exposed to air.

BACKGROUND ART

Generally, wine is stored in bottles sealed with cork-like stoppers to prevent exposure to air. However, once the cork is removed to enjoy the wine, the wine comes into contact with oxygen and oxidizes within a few hours, resulting in a sour taste instead of its original flavor.

Therefore, to enjoy the original taste of wine, it is best to consume the entire bottle quickly after opening. However, finishing an entire bottle at once is often impractical, necessitating a method to preserve leftover wine without oxidation.

One such conventional technology is described in Korean Registered Patent No. 10-2458153. This patent discloses a container providing internal storage space for beverages, a piston part that moves vertically while being in close contact with the container's inner surface, and a cap attached to the top of the piston part for opening and closing the container. However, this type of cap has the drawback of a complex structure, making it difficult to clean.

PATENT LITERATURE

PTL 1: KR 10-2458153 B1 (2022.10.19)

DISCLOSURE OF THE INVENTION

Technical Problem

The present invention has been devised to provide a beverage container and cap that can preserve beverages, such as wine, which are easily affected by air exposure, for a longer period. The present invention has also been devised to provide a cap with a simple structure that allows easy cleaning and effective opening and closing.

The present invention has further been devised to offer an opening and closing structure that reduces the number of rotations (or rotation angles) required to open or close the cap.

Moreover, the present invention has been devised to provide a cap that minimizes contact between the internal beverage and air through the user's simple operation.

Technical Solution

To address the aforementioned technical challenges, one aspect of the present invention provides a beverage container cap that is attached to the top of a container storing beverages or food items. The cap includes: a lower cap fastened to the top of the container; a beverage tube for dispensing the stored beverage; and an upper cap rotationally coupled to the lower cap, wherein the upper cap presses the beverage tube according to its degree of rotation, thereby opening or closing the container.

The beverage tube may include a vertical tube formed in an up-and-down direction, with one end located inside the container, and a horizontal tube extending in a bent form from the other end of the vertical tube.

The upper cap may include an upper sealing part protruding from its lower surface toward the lower cap, which presses the beverage tube when the upper cap rotates.

The upper sealing part may vary the degree of pressure applied to the beverage tube depending on the extent of rotation.

The upper sealing part may be formed with a protruding slope in a predetermined direction.

The predetermined direction may be a circumferential direction centered on the rotational axis of the upper cap. The lower cap may include a lower sealing part protruding from its upper surface toward the upper cap.

The upper sealing part and the lower sealing part may be arranged on the same circumference centered on the rotational axis of the upper cap.

The lower sealing part may be formed with a slope protruding in a predetermined direction.

The upper sealing part may include an upper stopper at one end, and the lower sealing part may include a lower stopper at one end.

Advantageous Effects

The present invention has the effect of preserving beverages, such as wine, which easily deteriorate when exposed to air, for a longer duration. Additionally, the invention provides a cap that is easy to clean due to its simple structure, while also enabling effective opening and closing.

In particular, it has the effect of offering an opening and closing structure that reduces the number of rotations (or rotation angles) required to operate the cap. Furthermore, the invention minimizes contact between the stored beverage and air with simple user operation.

MODE FOR CARRYING OUT THE INVENTION

Hereinafter, the embodiments disclosed in this specification will be described in detail with reference to the accompanying drawings. Identical or similar components will be assigned the same reference numbers, and redundant descriptions will be omitted. In the following explanation, suffixes such as "module" and "part" used for the components are given solely for the convenience of drafting the specification and do not imply any distinction in meaning or role.

Additionally, in describing the embodiments disclosed in this specification, specific details of related known technologies may be omitted if it is determined that such details could obscure the essence of the embodiments. Furthermore, the drawings attached hereto are intended to facilitate understanding of the embodiments disclosed in this specification and are not meant to limit the technical concept of the present invention. All modifications, equivalents, and substitutes that fall within the scope of the invention's technical concept and range are to be understood as included.

Terms like "first" and "second" are used to describe various components, but such components are not limited by these terms. The terms are used solely to distinguish one component from another.

When a component is described as being "connected" or "coupled" to another component, it can be either directly connected or coupled or connected/coupled with an intervening component. Conversely, when a component is described as being "directly connected" or "directly coupled," there are no intervening components.

Singular expressions are to be interpreted as including plural expressions unless the context clearly indicates otherwise.

In the present application, terms such as "comprises" or "has" are intended to specify the presence of features, numbers, steps, operations, components, parts, or their combinations described in the specification and do not preclude the possibility of the presence or addition of one or more other features, numbers, steps, operations, components, parts, or their combinations.

Figure 1:
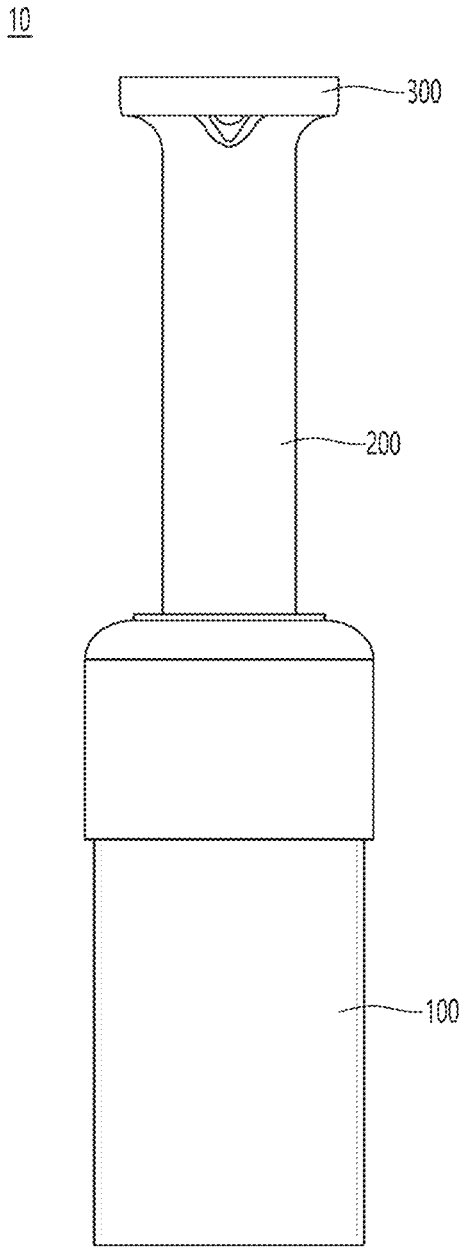
FIG. 1 is a front view of a beverage container according to an embodiment of the present invention.

FIG. 1 is a front view of a beverage container according to the first embodiment of the present invention.

Referring to FIG. 1, the beverage apparatus 10 comprises a container 100, a piston part 200, and a cap 300.

The container 100 has an open top and can store beverages or food items inside.

The piston part 200 moves vertically while being in close contact with the inner surface of the container 100, effectively removing air from inside the container 100 depending on the remaining amount of beverage.

the cap 300 is detachably mounted above the piston part 200 to prevent air from entering the container 100.

The container 100 in the first embodiment of the present invention can store beverages or food items such as cooking oil or wine.

For such beverage storage containers 100, certain essential features are required. Since the container is used to store beverages for consumption, it must be easy to clean, and to block external contaminants, the opening and closing mechanism must be secure.

Additionally, for applications such as storing cooking oil for culinary purposes, the opening and closing operation must be simple and convenient.

Furthermore, due to the characteristics of beverages, the container should allow for gradual dispensing over a long period.

To meet these requirements, the structure of the opening and closing mechanism should be as simple as possible. A simpler structure not only facilitates disassembly for cleaning but also makes it easier to remove any residue from the beverages.

Therefore, the cap structure of the present invention, as described below, is characterized by being designed with the simplest possible configuration to satisfy the aforementioned features. Specifically, the proposed structure allows for dispensing the beverage stored inside the container 100 not only by tilting the container 100, as seen in FIG. 1, but also through pressure applied to the container 100. According to the structure shown in FIG. 1, the piston part 200 slides vertically, applying pressure to the beverage stored inside the container 100, which is then dispensed as a result of this applied pressure.

The cap 300 structure of the present invention is not limited to dispensing through applied pressure but can also be effectively applied to such dispensing methods.

Next, the structure of the cap 300 according to the first embodiment of the present invention will be described in detail with reference to the drawings.

Figure 2:
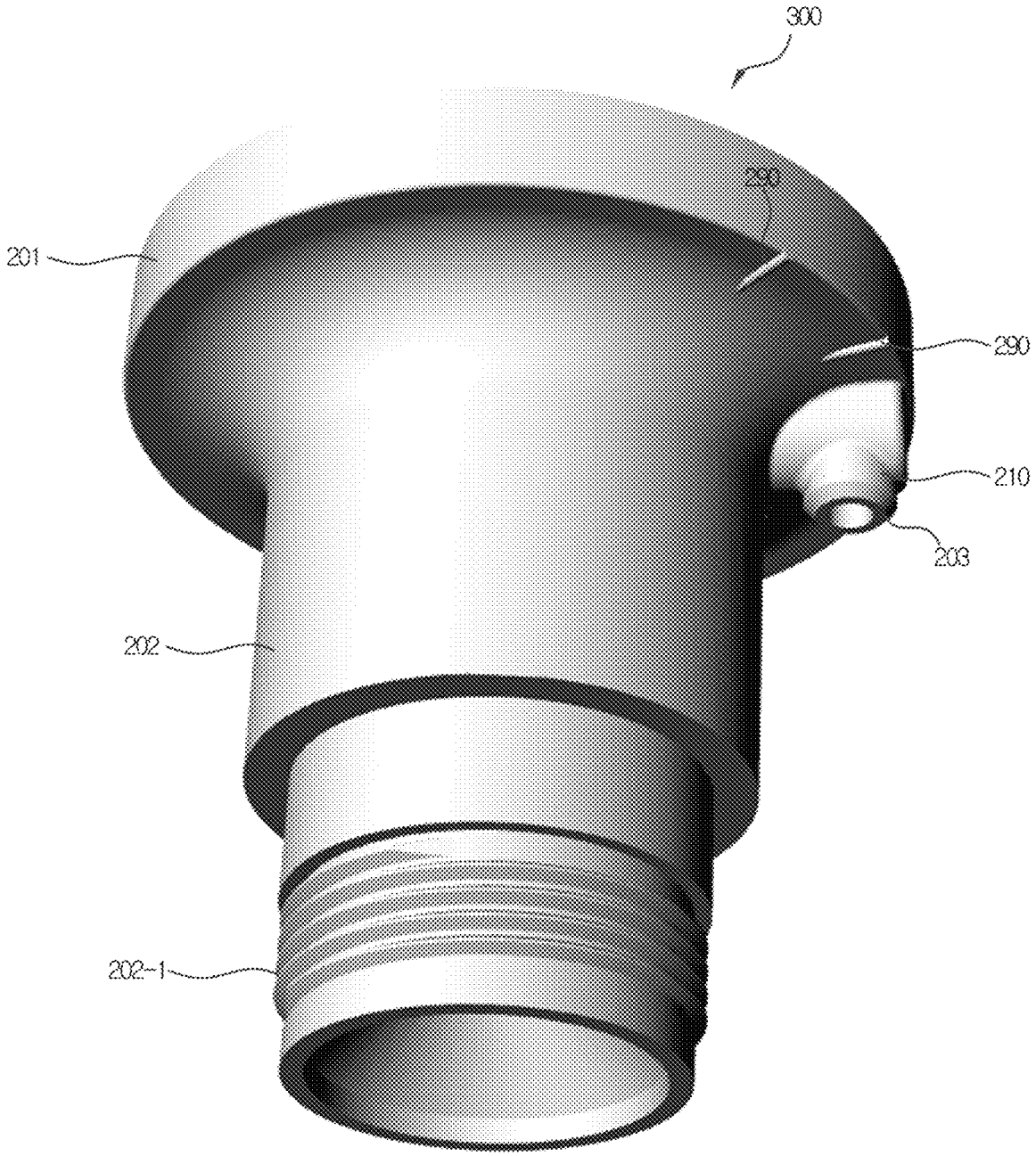
FIG. 2 is a lower perspective view showing the lower cap 202 according to an embodiment of the present invention.

FIG. 2 is a lower perspective view of the lower cap 202 according to the first embodiment of the present invention.

Figure 3:
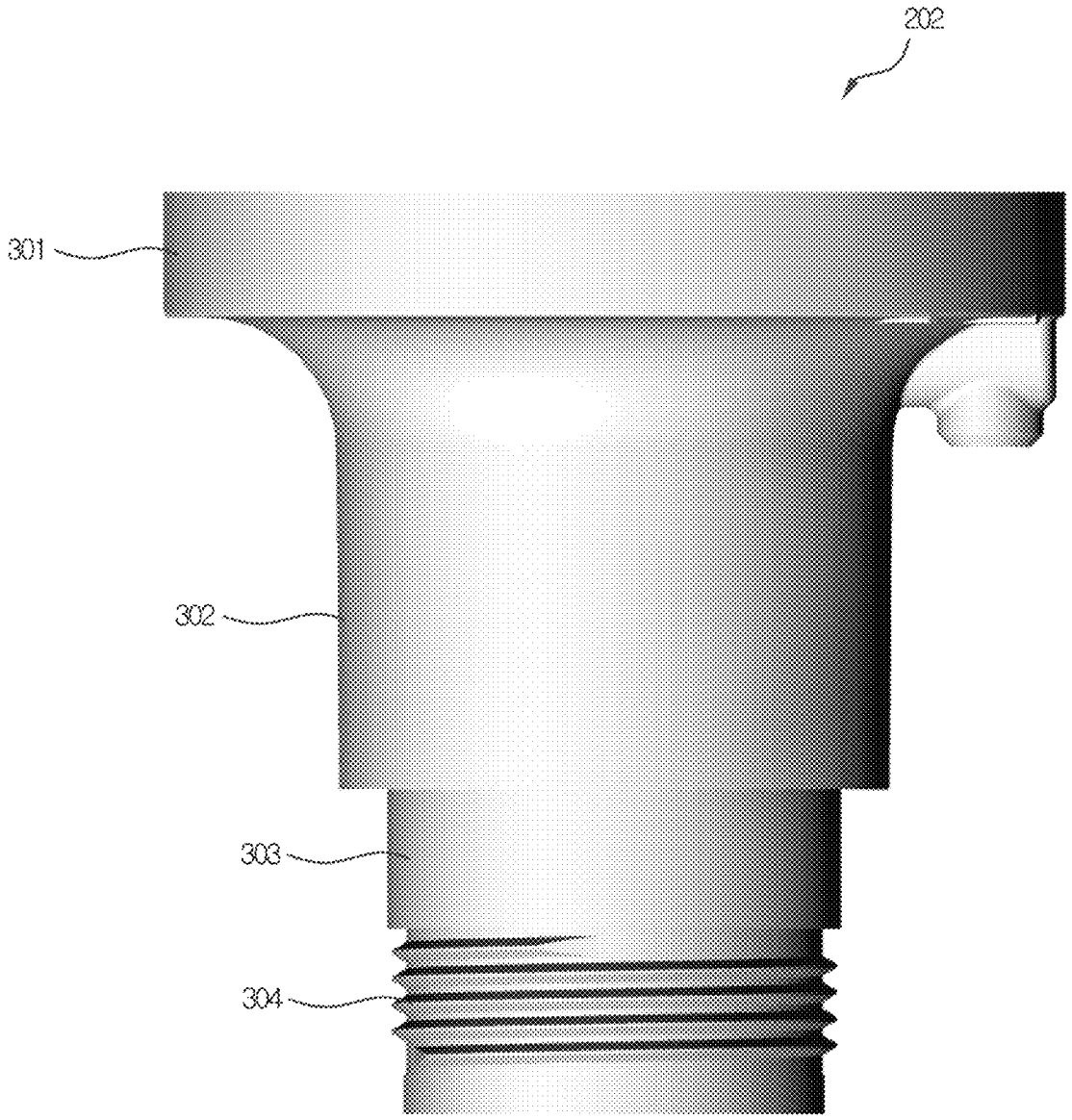
FIG. 3 is a side view showing the lower cap 202 according to an embodiment of the present invention.

FIG. 3 is a side view of the lower cap 202 according to the first embodiment of the present invention.

Figure 4:
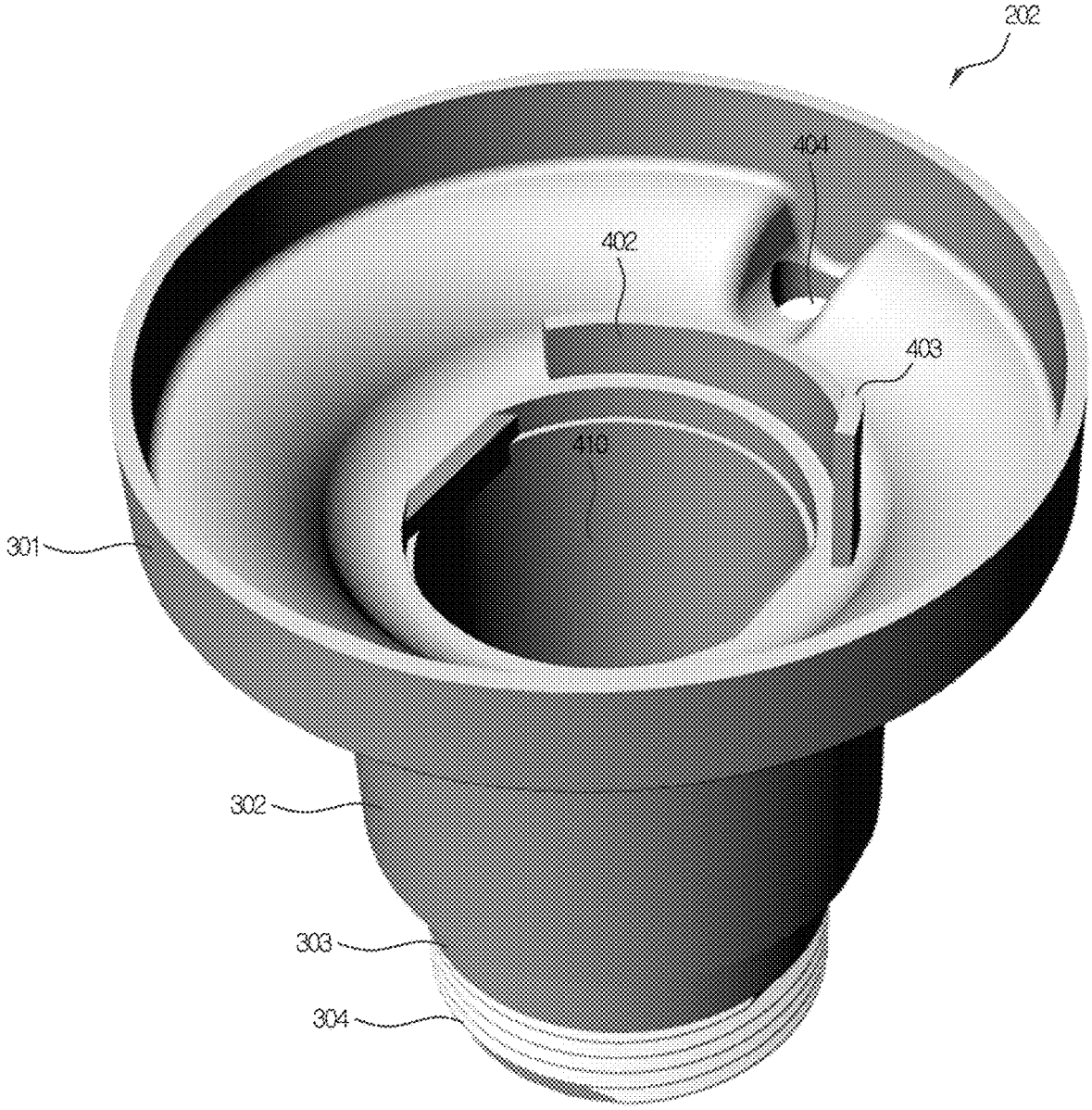
FIG. 4 is an upper perspective view of the cap 300 with the upper cap removed, according to an embodiment of the present invention.

FIG. 4 is an upper perspective view of the cap 300 with the upper cap removed, according to the first embodiment of the present invention.

Figure 6:
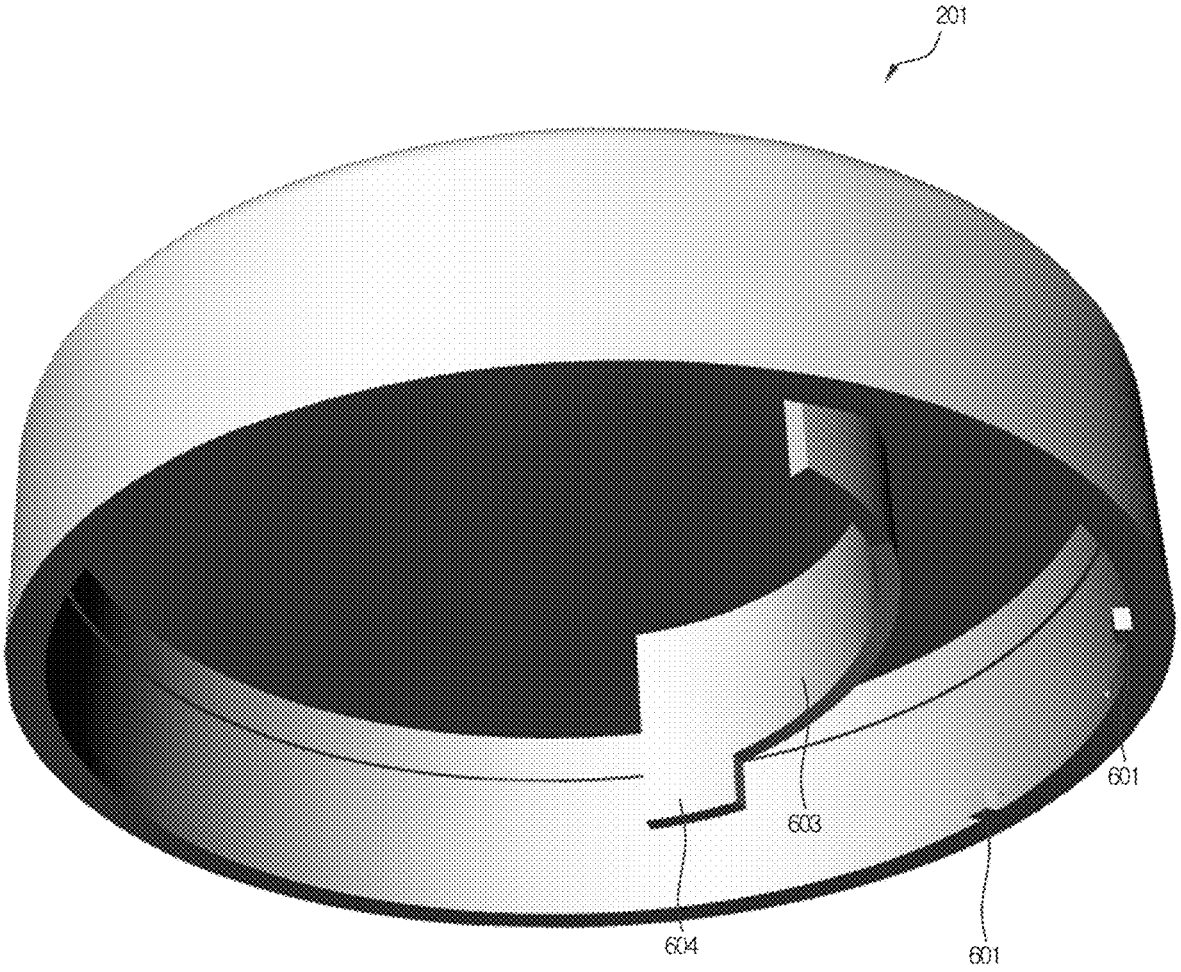
FIG. 6 is a diagram illustrating the beverage tube 203 according to an embodiment of the present invention.

FIG. 6 is a perspective view of the upper cap 201 according to the first embodiment of the present invention.

Figure 7:
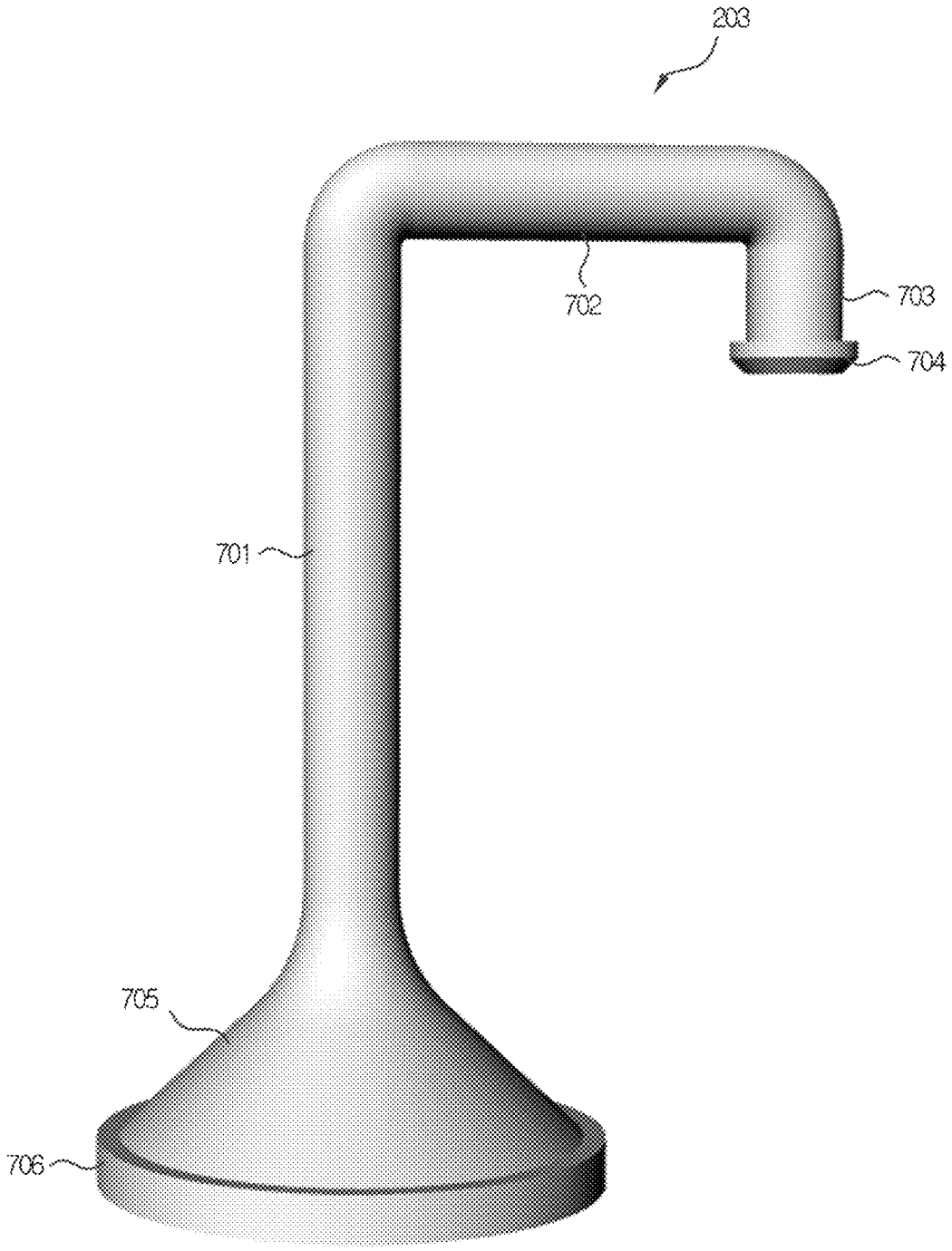
FIG. 7 is a diagram separately illustrating the beverage tube 203 and the fixing pin 401 used to secure it to the lower cap 202 according to an embodiment of the present invention.

FIG. 7 is a diagram illustrating the beverage tube 203 according to the first embodiment of the present invention.

Figure 8:
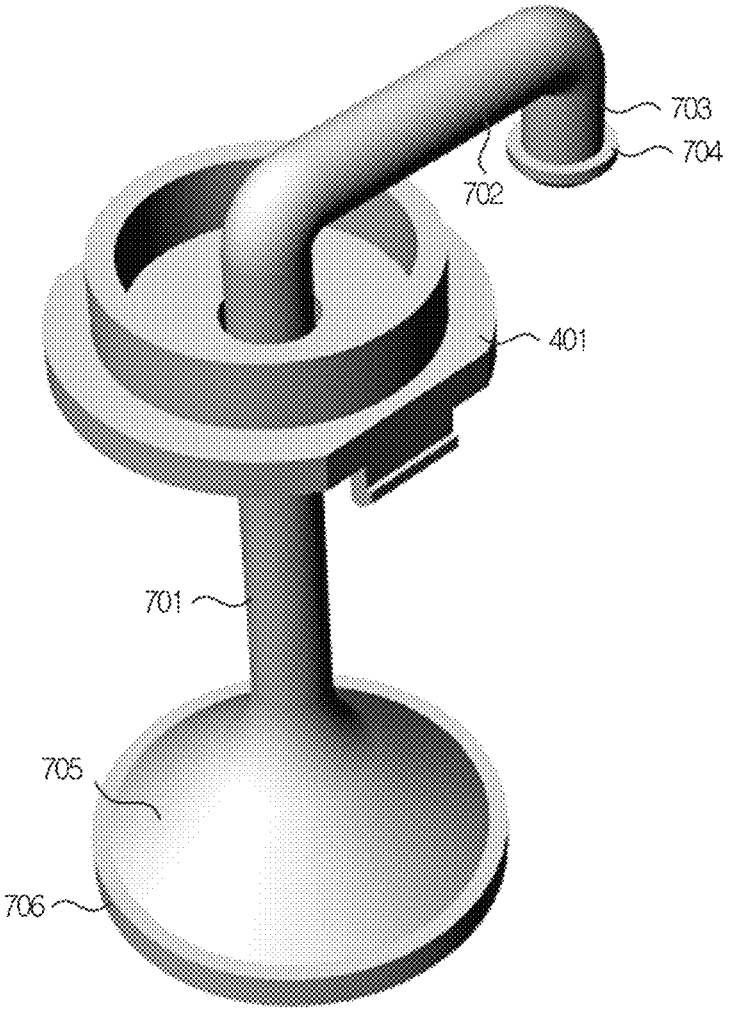
FIG. 8 is an upper perspective view of the lower cap 202 according to an embodiment of the present invention.

FIG. 8 is a diagram separately illustrating the beverage tube 203 and the fixing pin 401 used to secure it to the lower cap 202 according to the first embodiment of the present invention.

Figure 5:
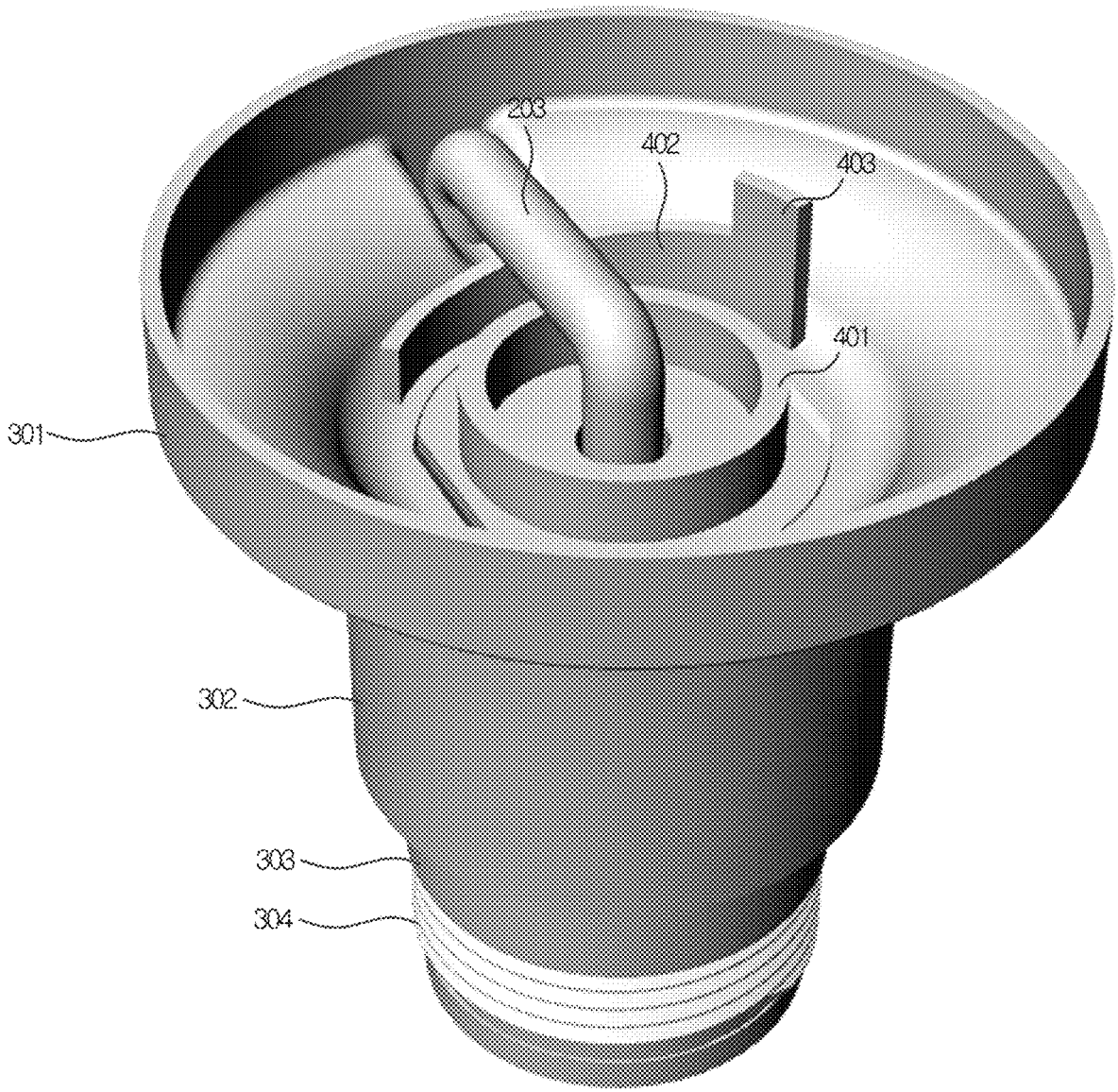
FIG. 5 is a perspective view of the upper cap 201 according to an embodiment of the present invention.

FIG. 5 is an upper perspective view of the lower cap 202 according to the first embodiment of the present invention.

Hereinafter, the structure of the cap 300 according to the first embodiment of the present invention will be described with reference to FIGS. 2 through 8.

the cap 300 according to the first embodiment of the present invention may include a lower cap 202 fastened to the top of the container 100, a beverage tube 203 for dispensing the beverage stored in the container 100, and an upper cap 201 rotationally coupled to the lower cap 202.

The lower cap 202 may be attached to the container 100 in a fitting engagement or through a screw-type connection by forming threads 202-1 on the lower end of the cap, as shown in the drawings. The container 100 may also have corresponding threads (not shown) to enable this screw connection.

Referring to FIGS. 3 through 5, the specific shape of the lower cap 202 will be described.

The lower cap 202 may consist of a body part 302, a threaded part 303, and a cup part 301. These components can be individually formed and assembled or integrally formed.

The body part 302, threaded part 303, and cup part 301 of the lower cap 202 can be generally formed as a cylindrical structure with holes running vertically through them.

The body part 302 forms the main structure of the lower cap 202 and is preferably shaped as a cylinder. Its outer diameter matches that of the container 100, ensuring no step is formed at the connection point when the body part 302 is fastened to the container 100.

The threaded part 303 extends downward from the body and has threads 304 formed on its outer surface. Preferably, the diameter of the threaded part 303 is smaller than that of the body part 302.

The cup part 301 is positioned at the upper end of the body part, forming a cup-shaped structure with internal space. Preferably, the diameter of the cup part 301 is larger than that of the body part 302 and the threaded part 303.

The outer surface of the cup part 301 can be coupled to the inner surface of the upper cap 201 in an interlocking manner. Both the outer surface of the cup part 301 and the inner surface of the upper cap 201 are cylindrical, allowing the upper cap 201 to be rotationally coupled to the cup part 301.

At the bottom of the cup part 301, at least one latch 290 protrudes downward. The latch 290 interacts with the protrusion 601 on the upper cap 201, securing the cap in place when it is rotated.

In one embodiment of the present invention, the upper cap 201 rotates relative to the lower cap 202, allowing the container 100 to open and close. The opening and closing of the container 100 refer to enabling the beverage stored inside the container to be dispensed externally or preventing foreign substances from entering the container.

Furthermore, the upper cap 201 in the first embodiment of the present invention is proposed to adjust the degree of opening and closing based on its rotational angle relative to the lower cap 202. The degree of opening and closing refers to the variation in flow rate when dispensing the beverage, more specifically, the adjustment of the cross-sectional area of the dispensing tube.

In this embodiment, as the upper cap 201 rotates relative to the lower cap 202, the pressure applied to the beverage tube 203 changes. Consequently, the cross-sectional area of the beverage tube 203 is adjusted based on the applied pressure.

The bottom surface of the space formed inside the cup part 301 includes a main hole 410, a lower sealing part 402, and a dispensing hole 404.

The main hole 410 allows the beverage tube 203 to pass through. As shown in FIG. 5, a fixing pin 401 secures the beverage tube 203 to the main hole 410.

The beverage tube 203 extends through the main hole 410 toward the dispensing hole 404 in a bent configuration, with one end passing through the dispensing hole 404 and being exposed externally.

In the direction where the beverage tube 203 bends, a lower sealing part 402 is formed. The lower sealing part 402 protrudes from the bottom surface of the cup part 301. At one end of the lower sealing part 402, a lower stopper 403 is provided.

Referring to FIG. 6, the specific shape and configuration of the upper cap 201 will be described.

The upper cap 201 is designed in an inverted cup shape to form an internal space and is configured to cover the lower cap 202.

As described earlier, the inner surface of the upper cap 201 corresponds to the outer surface of the lower cap 202, allowing for an interlocking fit and easy detachment.

Inside the upper cap 201, an upper sealing part 603 is provided. The upper sealing part 603 protrudes downward from the bottom surface of the upper cap 201 toward the lower cap. Additionally, an upper stopper 604 is formed at one end of the upper sealing part 603.

The inner surface of the upper cap 201 includes at least one protrusion 601 that extends inward. When the upper cap 201 is rotated, the protrusion 601 engages with the latch 290 on the lower cap 202, holding it securely and maintaining pressure on the beverage tube 203 without requiring additional force.

Hereinafter, referring to FIG. 9, the shapes of the lower sealing part 402 and the upper sealing part 603, as well as the roles of the upper stopper 604 and the lower stopper 403, will be explained in more detail.

Referring to FIGS. 7 and 8, the structure of the beverage tube 203 according to the first embodiment of the present invention will be described.

In the first embodiment of the present invention, the beverage tube 203 may include a vertical tube 701 formed in an up-and-down direction with one end positioned inside the container, and a horizontal tube 702 extending in a bent shape from the other end of the vertical tube.

The beverage tube 203 in the first embodiment is arranged in the main hole 410 of the lower cap 202 and is designed to discharge the beverage stored inside the container 100 to the outside. The interior of the beverage tube 203 forms a tubular space that allows the beverage to pass through, and it is configured as a tube.

The horizontal tube 702 is configured to extend and bend from the vertical tube 701 toward the dispensing hole 404. Additionally, the discharge tube 703 is configured to extend downward from the horizontal tube 702 toward the dispensing hole 404.

The beverage tube 203, comprising the vertical tube 701, horizontal tube 702, and discharge tube 703 in the first embodiment of the present invention, may appear as an inverted 'n' shape when viewed from the side. The vertical tube 701 and the discharge tube 703 are parallel to each other, and the vertical tube 701 bends at a right angle to form the structure.

At the tip of the discharge tube 703, a protruding tip portion 704 is formed with a larger diameter than the discharge tube 703 itself. The diameter of the tip portion 704 is greater than the inner diameter of the dispensing hole 404, allowing it to fit securely into the dispensing hole 404 and remain stably fixed when inserted.

The lower part of the vertical tube 701 includes a funnel portion 705 and a sealing portion 706.

The funnel portion 705 is configured to gradually widen in diameter from the lower part of the vertical tube 701. Below the funnel portion 705, a sealing portion 706 is formed, which completely adheres to the inner surface of the piston part 200 or the container 100. This ensures that the beverage is entirely transferred into the interior of the beverage tube 203.

The components of the beverage tube 203 in the first embodiment, including the vertical tube 701, horizontal tube 702, discharge tube 703, tip portion 704, funnel portion 705, and sealing portion 706, may either be separately manufactured and assembled or integrally formed as a single structure. For instance, in a preferred embodiment, the beverage tube 203 can be made of materials such as rubber or silicone, and all these components—the vertical tube 701, horizontal tube 702, discharge tube 703, tip portion 704, funnel portion 705, and sealing portion 706—can be molded into an integrated design.

When the components of the beverage tube 203 are integrally formed as described above, it offers advantages such as easy disassembly for cleaning and a simple structure that prevents foreign substances from becoming trapped.

Hereinafter, referring to FIG. 9, the concept of applying pressure to the beverage tube 203 through the slopes of the lower sealing part 402 and the upper sealing part 603 will be explained.

FIG. 9 is a conceptual diagram explaining how the lower sealing part 402 and the upper sealing part 603 press the beverage tube 203 according to the first embodiment of the present invention.

From the structures shown in FIGS. 2 through 8, the lower sealing part 402 and the upper sealing part 603 may be formed in a circumferential direction centered on the rotational axis of the upper cap 201. In FIG. 9, the lower sealing part 402 and the upper sealing part 603 are shown as being formed on a flat surface for conceptual explanation. However, in practice, they may be curved or shaped like a semicircle or a sector.

The diagram illustrates how the slopes formed on the lower sealing part 402 and the upper sealing part 603 press the beverage tube 203 or a part of it. The specific slope angles and the relative scales between the stoppers and the slopes may vary from what is depicted in FIG. 9.

Figure 9B:
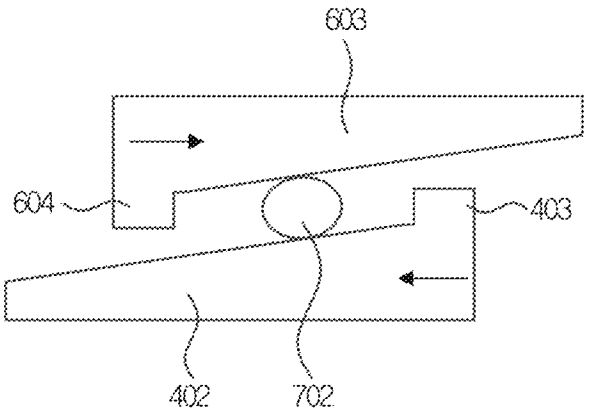
FIGS. 9A and 9B are conceptual diagrams explaining how the beverage tube 203 is pressed by the lower sealing part 402 and the upper sealing part 603 according to the first embodiment of the present invention.
Figure 9A:
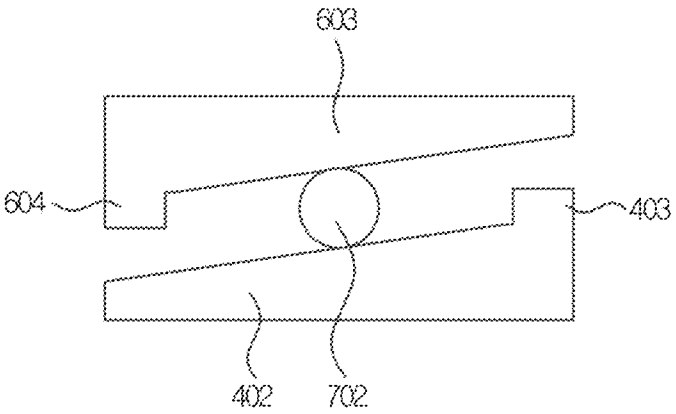

FIG. 9A shows the open state where the lower sealing part 402 and the upper sealing part 603 are at their initial positions. FIG. 9B shows a partially closed state where the relative positions of the sealing parts have changed due to the rotation of the upper cap 201 relative to the lower cap 202.

In the relative positioning shown in FIGS. 9A and 9B, the beverage tube 203 or its horizontal portion 702 is located between the lower sealing part 402 and the upper sealing part 603.

The lower sealing part 402 and the upper sealing part 603 may be symmetrically shaped. In other words, the lower sealing part 402 can be mirror-symmetrical to the upper sealing part 603 based on a certain reference point. Alternatively, the lower sealing part 402 may become identical to the upper sealing part 603 if it is rotated 180 degrees.

Hereinafter, the shape of the lower sealing part 402 will be described as a reference, but the description equally applies to the upper sealing part 603.

The lower sealing part 402 in the first embodiment of the present invention may have a slope that gradually increases in height from one end (shown on the left in the diagram) to the other end (shown on the right in the diagram). A lower stopper 403 may be provided at the other end of the lower sealing part 402.

When the upper cap 201 rotates, the relative height between the lower sealing part 402 and the upper sealing part 603 remains unchanged. However, as their relative position changes, as shown from FIG. 9A to FIG. 9B, the slopes press the beverage tube 203. When the circular cross-section of the beverage tube is compressed, it becomes elliptical, reducing its cross-sectional area. As the relative position changes further, the applied pressure increases, and the cross-sectional area of the tube decreases proportionally. In other words, the more the upper cap 201 is rotated, the more the tube is closed.

Furthermore, the present invention proposes a structure in which the upper stopper 604 and the lower stopper 403 formed on the upper sealing part 603 and the lower sealing part 402, respectively, allow for complete opening and closing. This is explained with reference to FIG. 10.

Figure 10:
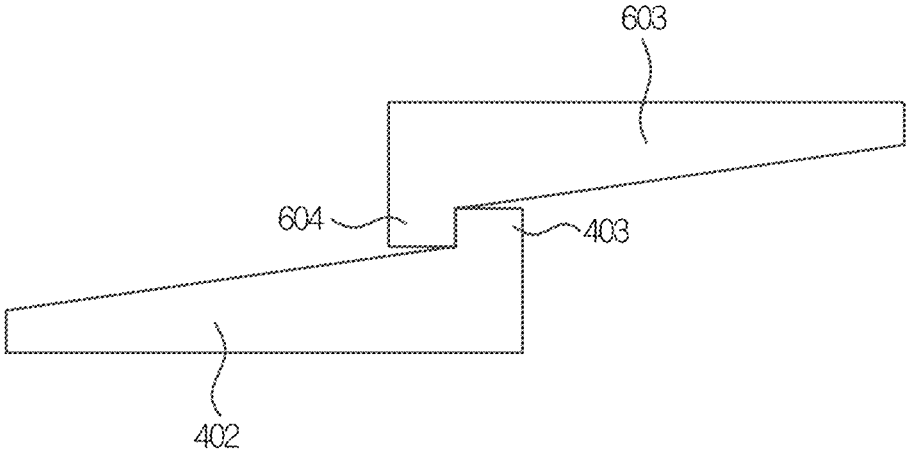
FIG. 10 explains the role of the upper stopper 604 and the lower stopper 403 according to the first embodiment of the present invention.

FIG. 10 illustrates the role of the upper stopper 604 and the lower stopper 403 in the first embodiment of the present invention.

As the relative positional change shown in FIG. 9 continues, the upper stopper 604 and the lower stopper 403 eventually come into contact with each other, with the beverage tube 203 in between. When sufficient pressure is applied, the stoppers completely compress the beverage tube 203, achieving a fully closed state.

Figure 11:
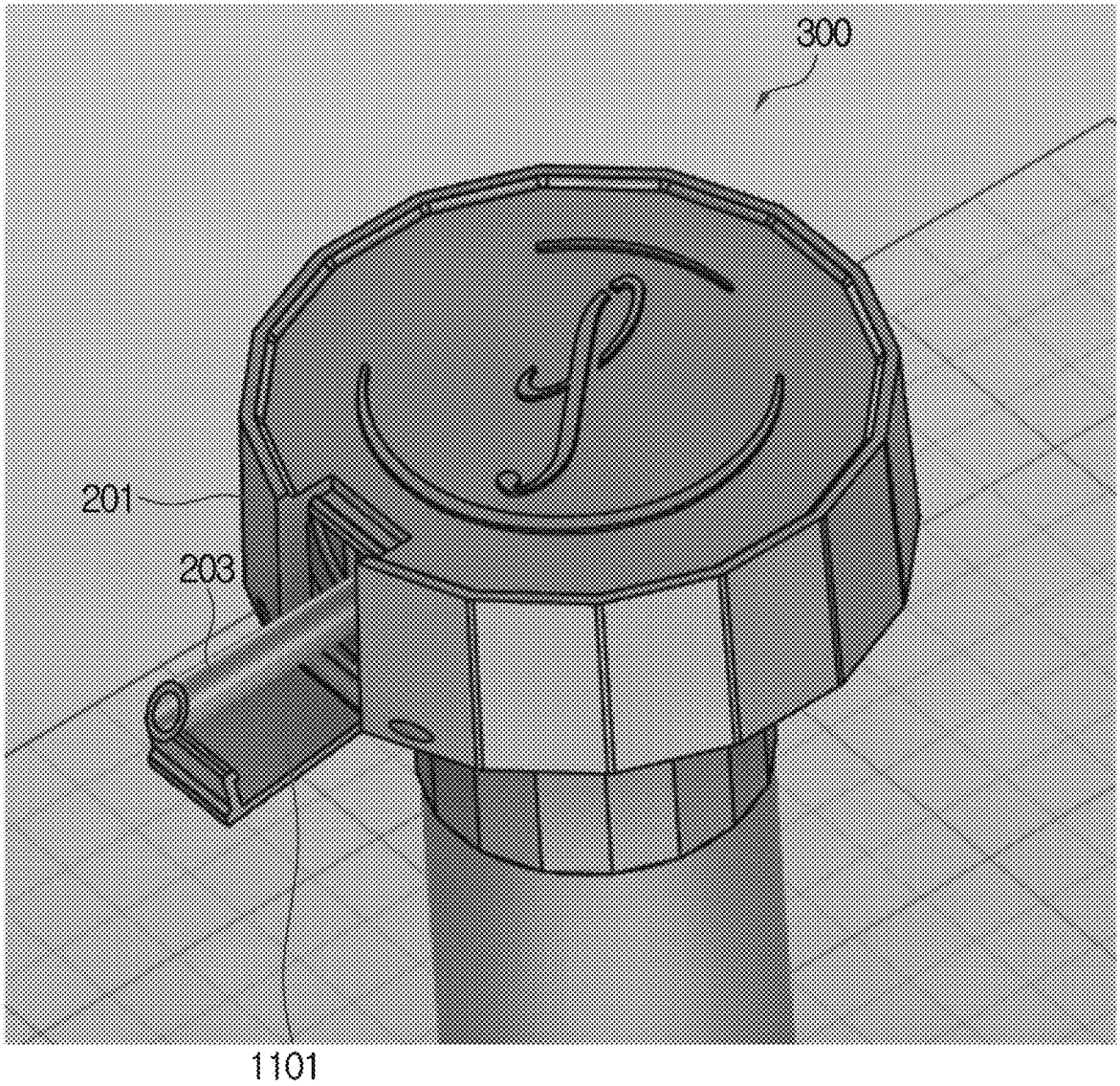
FIG. 11 is a perspective view of the cap 300 according to the second embodiment of the present invention.
Figure 12:
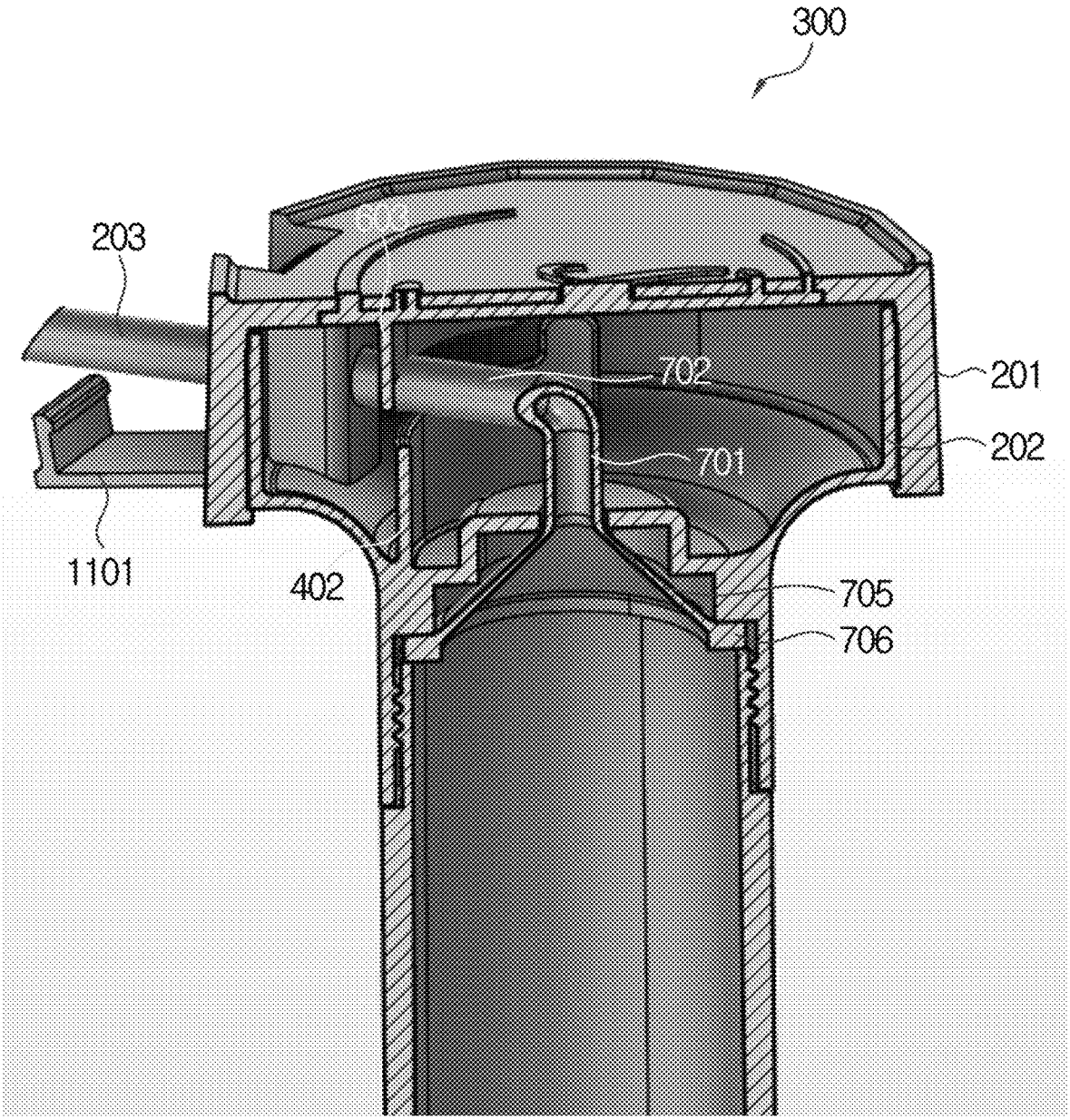
FIGS. 12 and 13 are internal cross-sectional views of the cap 300 according to the second embodiment of the present invention.
Figure 13:
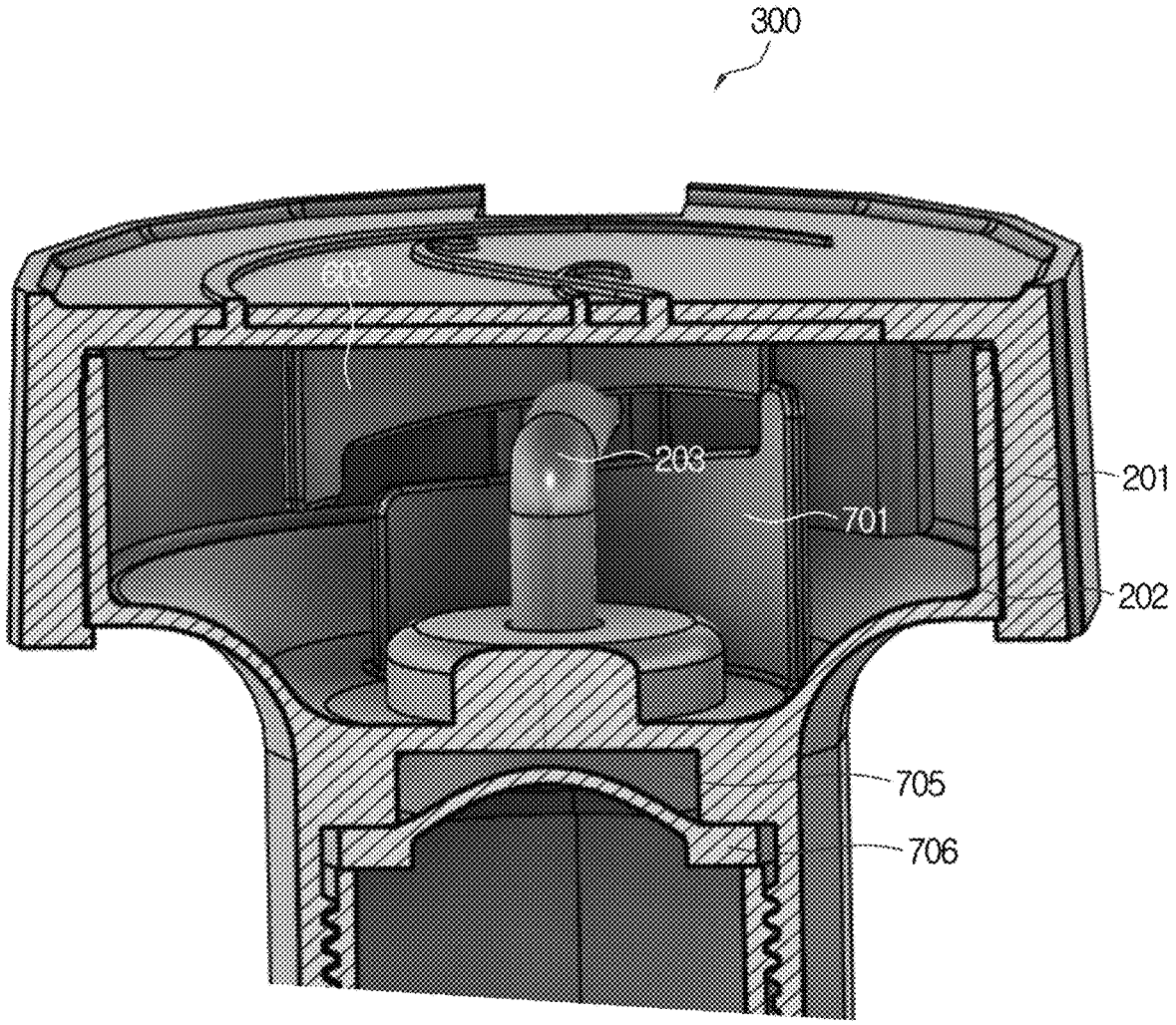

FIGS. 11 through 13 illustrate the structure according to the second embodiment of the present invention.

Hereinafter, descriptions of the second and third embodiments will reference these figures, and components operating based on the same principles as those in the first embodiment will use the same identifiers, omitting repetitive explanations.

FIG. 11 is a perspective view of the cap 300 according to the second embodiment of the present invention.

FIGS. 12 and 13 are internal cross-sectional views of the cap 300 according to the second embodiment of the present invention.

Referring to FIGS. 11 through 13, the cap 300 in the second embodiment is configured to further include an opening and closing part 1101 for controlling a portion of the side of the upper cap 201.

In the first embodiment, the beverage tube 203 was configured with a vertical tube 701, a horizontal tube 702, and a discharge tube 703 forming an inverted 'n' shape. However, in the second embodiment, the beverage tube 203 is configured with a vertical tube 701 and a horizontal tube 702, omitting the discharge tube 703, and overall forming an "L" shape.

One end of the cover 1101 is rotatably coupled to one side of the upper cap 201. When the cover 1101 is closed, the protruding beverage tube 203 is bent, sealing itself. Conversely, when the cover 1101 is opened, the bent beverage tube 203 is allowing beverage straightened, releasing the seal and dispensing.

Additionally, the cap 300 in the second embodiment of the present invention can also utilize the slopes of the lower sealing part 402 and the upper sealing part 603 to press the beverage tube 203, as described in FIG. 9 in relation to the first embodiment. In other words, the cover 1101 primarily seals the beverage tube 203 by bending it, achieving the first level of sealing. Subsequently, the slopes of the lower sealing part 402 and the upper sealing part 603, along with the lower stopper 403 and the upper stopper 604, provide a second level of sealing.

Next, referring to FIGS. 14 and 15, the third embodiment of the present invention will be described.

Third Embodiment

Figure 14:
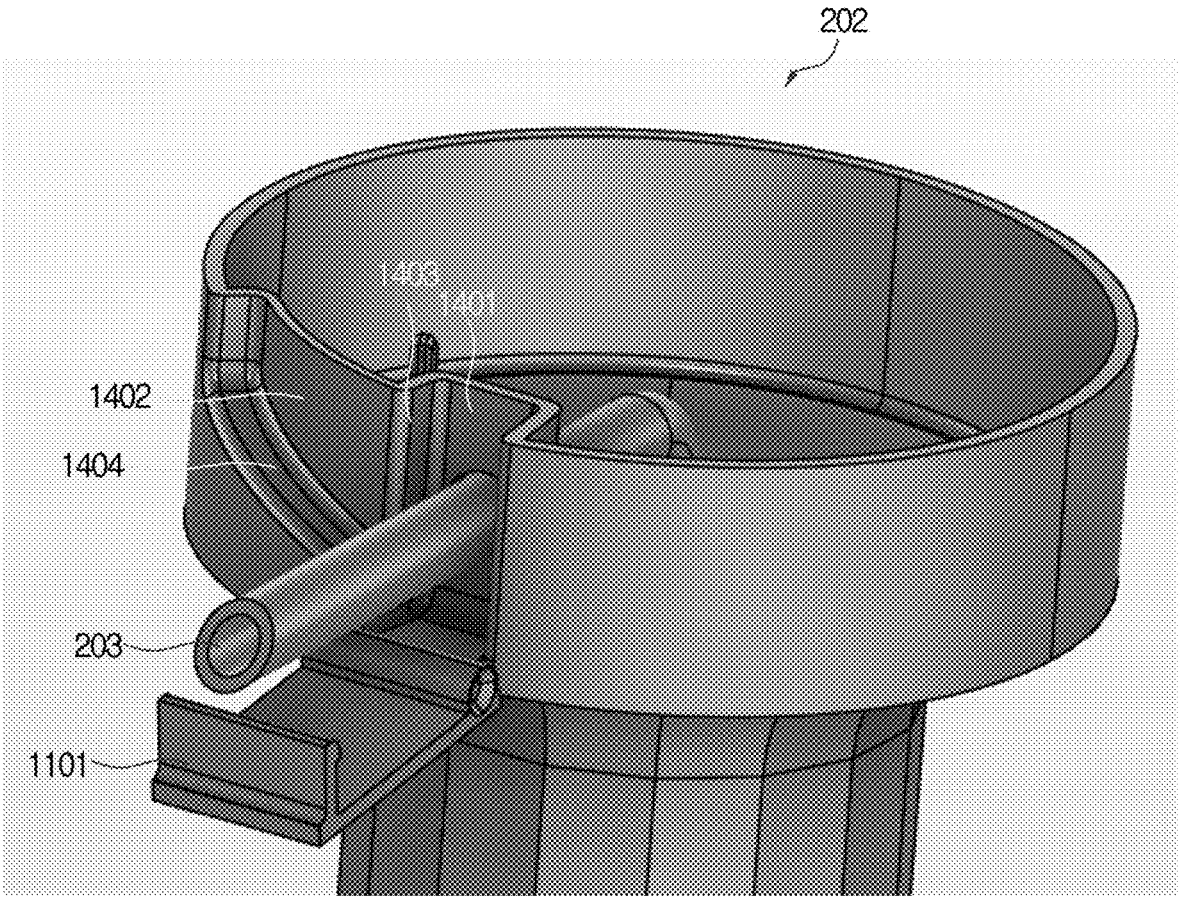
FIGS. 14 and 15 illustrate the third embodiment of the present invention.
Figure 15:
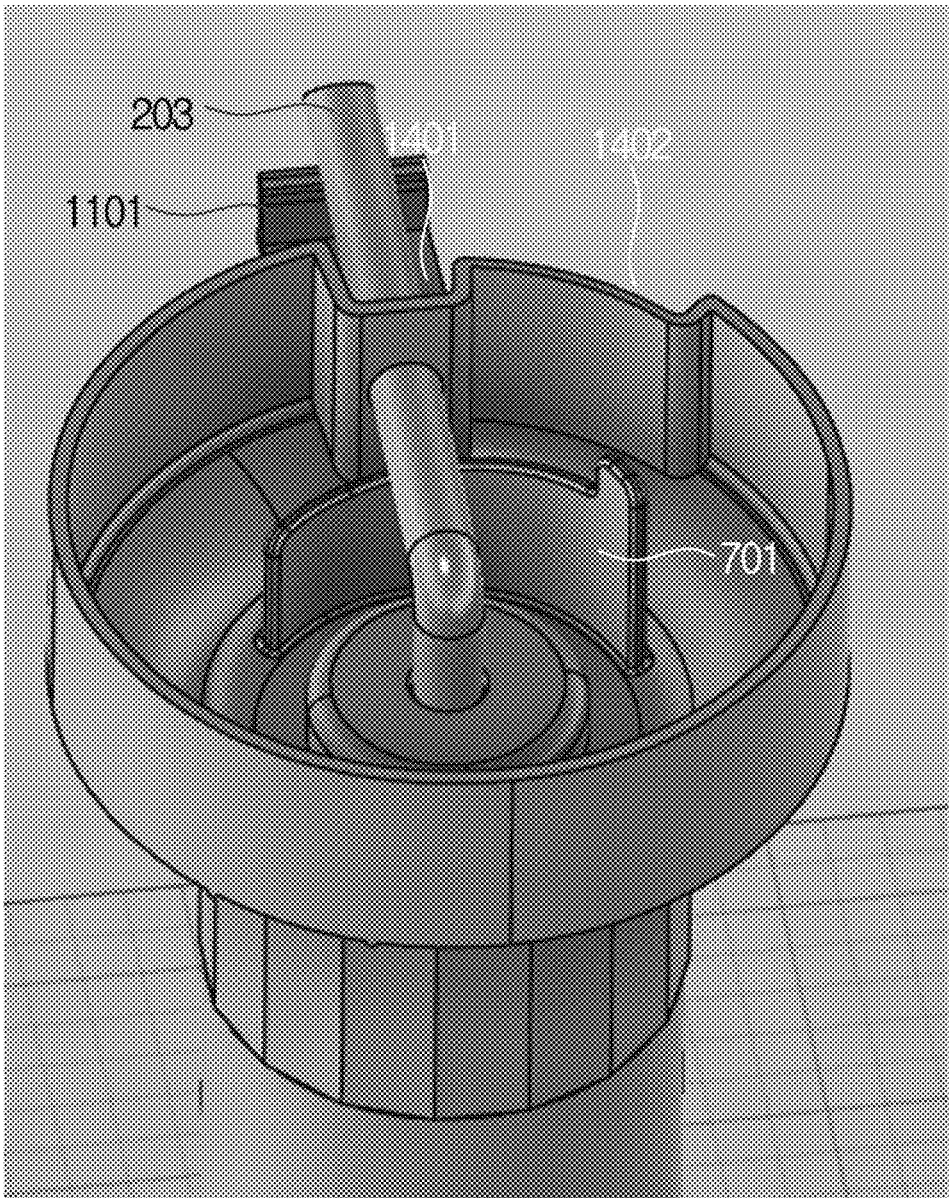

FIGS. 14 and 15 illustrate the third embodiment of the present invention. In the third embodiment, the cap 300 is further configured with a first and second receiving part 1402 to accommodate the beverage tube 203 when the cover 1101 is closed. The components described in the first and second embodiments that operate on the same principles as those in the third embodiment will not be redundantly explained.

In the third embodiment, the first and second receiving parts 1402 are formed inside the outer surface of the upper cap 201 and extend inward. The first receiving part 1401 has a deeper depth than the second receiving part 1402, creating a step 1403 between the two.

In the third embodiment, the first level of sealing is achieved when the cover 1101 closes and bends the beverage tube 203, as described earlier. Similarly, the second level of sealing is achieved through the slopes of the lower sealing part 402 and the upper sealing part 603, along with the lower stopper 403 and the upper stopper 604.

Moreover, in the third embodiment, an additional third level of sealing is proposed. When the upper cap 201 is rotated, the beverage tube 203 is bent in the direction of the second receiving part 1402, further enhancing the sealing effect.

When the beverage tube 203 bends in the direction of the second receiving part 1402, the step 1403 formed between the first and second receiving parts 1402 applies pressure to the tube, achieving the third level of sealing.

Specifically, in the third embodiment, the second receiving part 1402 is proposed to include an incline 1404. When the beverage tube 203 bends toward the second receiving part 1402, any residual beverage inside the tube may leak out.

By forming the incline 1404 within the second receiving part 1402, the tip of the beverage tube 203 is elevated as it bends, minimizing potential leakage. In a further development, the fourth embodiment (not illustrated) proposes that the incline 1404 of the second receiving part 1402 is formed in the opposite direction, sloping downward. This design aims to ensure that no residual beverage remains in the tube when it is sealed.

In the fourth embodiment, as the upper cap 201 rotates (counterclockwise in the illustrated figures), the beverage tube 203 bends from the first receiving part 1401 toward the second receiving part 1402, achieving a third level of sealing. When the beverage tube 203 bends toward the second receiving part 1402, the step 1403 formed between the first and second receiving parts (1401, 1402) applies pressure to the tube, resulting in the third level of sealing, as explained in the third embodiment.

However, in the fourth embodiment, as the upper cap 201 rotates counterclockwise and the beverage tube 203 is accommodated, the downward slope of the incline in the second receiving part 1402 allows residual beverage inside the tube to drain out. Consequently, any remaining beverage in the beverage tube 203 can be discharged into the second receiving part 1402.

The above description outlines the embodiments of the beverage container according to the present invention. However, these embodiments serve as examples and do not limit the technical scope, construction, or operation of the present invention. The technical scope of the invention is not restricted by the drawings or their descriptions. Additionally, the concepts and embodiments proposed by the present invention may serve as a foundation for modifications or redesigns aimed at achieving the same objectives. Such modifications or equivalent constructions made by those skilled in the art fall within the technical scope of the present invention as defined by the claims. All variations, substitutions, and modifications that do not depart from the technical idea and scope described in the claims are intended to be included within the scope of the present invention.

DESCRIPTION OF REFERENCE NUMERALS

100: Container
200: Piston part
300: Cap

The invention claimed is:

1. A cap for opening and closing a container that stores beverages or food items, the cap comprising:
- a lower cap fastened to the top of the container;
- a beverage tube for dispensing the beverage, the beverage tube including:
- a vertical tube formed with one end positioned inside the container; and
- a horizontal tube extending from the other end of the vertical tube;
- an upper cap rotationally coupled to the lower cap, the upper cap including: an upper sealing part protruding from its lower surface toward the lower cap, wherein the upper cap applies pressure to the beverage tube based on the degree of its rotation, thereby opening or closing the container,
- wherein the upper sealing part presses the beverage tube when the upper cap rotates, wherein the lower cap includes a lower sealing part protruding from its upper surface toward the upper cap,
- wherein the upper sealing part and the lower sealing part are arranged on the same circumference centered on the rotational axis of the upper cap, and wherein the lower sealing part is formed with a protruding slope in a predetermined direction.

2. The cap of claim 1,
- wherein the upper sealing part adjusts the degree of pressure applied to the beverage tube based on the extent of rotation of the upper cap.

3. The cap of claim 2,
- wherein the upper sealing part is formed with a protruding slope in a predetermined direction.

4. The cap of claim 3,
- wherein the predetermined direction is a circumferential direction centered on the rotational axis of the upper cap.

5. The cap of claim 1,
- wherein the upper sealing part includes an upper stopper at one end, and
- the lower sealing part includes a lower stopper at one end.

6. The cap of claim 1,
- wherein the upper cap further includes a cover for opening and closing a portion of the upper cap's side, and
- wherein the cover, when closed, seals a portion of the beverage tube.

7. The cap of claim 6,
- wherein the cover is rotatably coupled to one side of the upper cap,
- and when the cover is closed, the beverage tube bends, sealing itself, and when the cover is opened, the beverage tube straightens, releasing the seal.

* * * * *